US006595248B1

(12) United States Patent
Rome et al.

(10) Patent No.: US 6,595,248 B1
(45) Date of Patent: Jul. 22, 2003

(54) AUTOMATED SERVICE EQUIPMENT AND METHOD FOR ENGINE COOLING SYSTEMS

(75) Inventors: John A. Rome, Huntington, CA (US); Bill Kavadeles, Carlsbad, CA (US)

(73) Assignee: Motorvac Technologies, Inc., Santa Ana, CA (US)

( * ) Notice: Subject to any disclaimer, the term of this patent is extended or adjusted under 35 U.S.C. 154(b) by 0 days.

(21) Appl. No.: 10/013,176

(22) Filed: Dec. 7, 2001

Related U.S. Application Data

(63) Continuation of application No. 09/766,345, filed on Jan. 19, 2001, now Pat. No. 6,360,791, which is a continuation-in-part of application No. 09/704,044, filed on Nov. 1, 2000, which is a continuation-in-part of application No. 09/498,820, filed on Feb. 4, 2000, now Pat. No. 6,247,509, which is a continuation of application No. 09/427,132, filed on Oct. 25, 1999, now Pat. No. 6,213,175, which is a continuation of application No. 09/184,621, filed on Nov. 2, 1998, now Pat. No. 6,062,275.

(51) Int. Cl.[7] ..... B65B 1/04
(52) U.S. Cl. ..... 141/98; 141/65; 184/1.5
(58) Field of Search ..... 141/98, 65, 301, 141/302, 94, 95, 311, 86, 87; 184/1.5

(56) References Cited

U.S. PATENT DOCUMENTS 4,109,703 A * 8/1978 Babish et al. ..... 165/95
4,938,315 A * 7/1990 Ohta et al. ..... 184/1.5
5,273,085 A * 12/1993 Edwards et al. ..... 141/83
5,289,837 A * 3/1994 Betancourt ..... 134/57 R
5,370,160 A * 12/1994 Parker ..... 141/98

* cited by examiner

*Primary Examiner*—Steven O. Douglas
(74) *Attorney, Agent, or Firm*—Farjami & Farjami LLP

(57) ABSTRACT

Methods and apparatuses are provided for servicing a system having a used fluid, an inlet and an outlet. An exemplary apparatus comprises a first hose capable of being connected to the inlet, a second hose capable of being connected to the outlet, a first fluid tank including a first new fluid, a second fluid tank including a second new fluid, a pump and a selector. The selector selects one of the tanks and the pump pumps the new fluid from the selected tank into the system through the first hose and the inlet, and the second hose receives the used fluid via the outlet. For example, the first and second fluid tanks may communicate with the pump via first and second valves, respectively, and the selector may open the first valve and close the second valve, so that the pump pumps the first new fluid from the first fluid tank.

25 Claims, 7 Drawing Sheets

AUTOMATED SERVICE EQUIPMENT AND METHOD FOR ENGINE COOLING SYSTEMS

RELATED APPLICATIONS

This application is a continuation of U.S. application Ser. No. 09/766,345, filed Jan. 19, 2001, now U.S. Pat. No. 6,360,791 which is a continuation of U.S. application Ser. No. 09/427,132, filed Oct. 25, 1999, now U.S. Pat. No. 6,213,175. The present application also claims priority, under 35 USC 120, as a continuation-in-part application of U.S. application Ser. No. 09/704,044, filed Nov. 1, 2000, which is a continuation-in-part application of U.S. application Ser. No. 09/498,820, filed Feb. 4, 2000, now U.S. Pat. No. 6,247,509, which is a continuation application of U.S. application Ser. No. 09/184,621, filed Nov. 2, 1998, now U.S. Pat. No. 6,062,275. All above-referenced applications are hereby fully incorporated by reference in the present application.

BACKGROUND OF THE INVENTION

1. Field of the Invention

The present invention relates to the field of vehicles' engines, and more specifically, the present invention is directed to servicing engines.

2. Background

Engine manufacturers highly recommend that engine cooling systems be serviced every 15,000 to 30,000 miles. Lack of proper service can cause engine problems due to the fact that old coolant in the vehicle's radiator system may no longer protect against rust or acids that can lead to a breakdown of the metal and aluminum parts in the engine. Periodic service intervals are recommended to protect the engine against overheating that can be caused by a breakdown of the coolant's protective properties.

To this end, automobile service stations utilize various systems and methods to replace old coolant in the radiator system with new coolant in accordance with the manufacturers' recommendation. Conventional systems, however, suffer from many problems. To mention a few, conventional systems cause coolant drainage and are environmentally hazardous. To prevent coolant drainage, service operators must place a pan under the vehicle to avoid coolant spill. Moreover, the radiator pressure cannot be released prior to removing the radiator cap which can place service operators in danger.

Furthermore, conventional systems require constant operator attention. For example, at the end of the coolant exchange, the operation must end immediately, otherwise the vehicle's coolant continues to be drained, and as a result, the vehicle's engine can overheat and be damaged. Even more, at the completion of the coolant exchange, the conventional systems require the operator to add more coolant manually in order to adjust the level of coolant in the radiator system. To that end, the operator must either prepare a mixture of coolant and water, or prior to starting the coolant exchange process, save some in a separate container. At the end of the coolant exchange, the additional coolant must either be deposited in the service system tank or be added to the radiator system by the operator. Indeed, such methods are extremely labor intensive, unsafe and time consuming.

Also, the operator of a conventional system must carefully monitor the amount of new coolant entering a vehicle's radiator system and the amount of used coolant flowing out of the vehicle's radiator system during the coolant exchange operation to avoid coolant spillage that could result from an unbalanced coolant flow. For example, if the amount of coolant flowing into a conventional system exceeds the amount of coolant that the conventional system can handle, the excess coolant could spill, resulting in a hazardous mess that requires time consuming clean up.

As another example of the shortcomings, in the existing systems, fluid flow control is achieved via a pressure switch that turns off the fluid flow completely when the system pressure reaches a predetermined level by stopping the system and/or engine and then restarting the system and/or engine when the system pressure falls below a second level. The on-to-off transitions are greatly harmful to the service system and the vehicle's engine.

In addition, servicing of different radiator systems may require service operators to utilize different types of coolant available from coolant manufacturers. However, the operator of a conventional system must first spend valuable service time required to drain existing coolant before adding a different coolant type to the conventional system's coolant supply tank. Also, a the operator of the conventional system must spend additional service time to clean the coolant supply tank to avoid cross fluid contamination from the previous coolant type.

Accordingly, an intense need exists for apparatus and method for servicing engine cooling systems that can safely and efficiently solve the existing problems in the art.

Further disadvantages of the related art will become apparent to one skilled in the art through comparison of the drawings and specification which follow.

SUMMARY OF THE INVENTION

In accordance with the purpose of the present invention as broadly described herein, there is provided method and apparatus for servicing engine cooling systems.

In one exemplary aspect, an apparatus is provided for servicing a system having a used fluid, an inlet and an outlet. The apparatus comprises a first hose capable of being connected to the inlet, a second hose capable of being connected to the outlet, a first fluid tank including a first new fluid, a second fluid tank including a second new fluid, a pump and a selector. The selector selects one of the fluid tanks and the pump pumps the new fluid from the selected fluid tank into the system through the first hose and the inlet, and the second hose receives the used fluid via the outlet.

In a further exemplary aspect, the first fluid tank communicates with the pump via a first valve and the second fluid tank communicates with the pump via a second valve, and wherein the selector opens the first valve and closes the second valve, so that the pump pumps the first new fluid from the first fluid tank. In another exemplary aspect, the first fluid tank communicates with the pump via a first valve and the second fluid tank communicates with the pump via a second valve, and wherein the selector opens the second valve and closes the first valve, so that the pump pumps the second new fluid from the second fluid tank.

The apparatus may further comprise an output flow sensor coupled to the first hose, a return flow sensor coupled to the second hose, and a controller in communication with the output flow sensor for measuring an output rate of flow and in communication with the return flow sensor for measuring a return rate of flow, wherein the controller controls the pump based on the return rate of flow and the output rate of flow.

In some aspects, the apparatus may also comprise a purge pump capable of purging the used fluid and the new fluid in the first hose and the second hose. In addition, the apparatus may comprise a third fluid tank including a third new fluid, wherein the first new fluid is the same as the third new fluid.

Other aspects of the present invention will become apparent with further reference to the drawings and specification, which follow.

BRIEF DESCRIPTION OF DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1A:
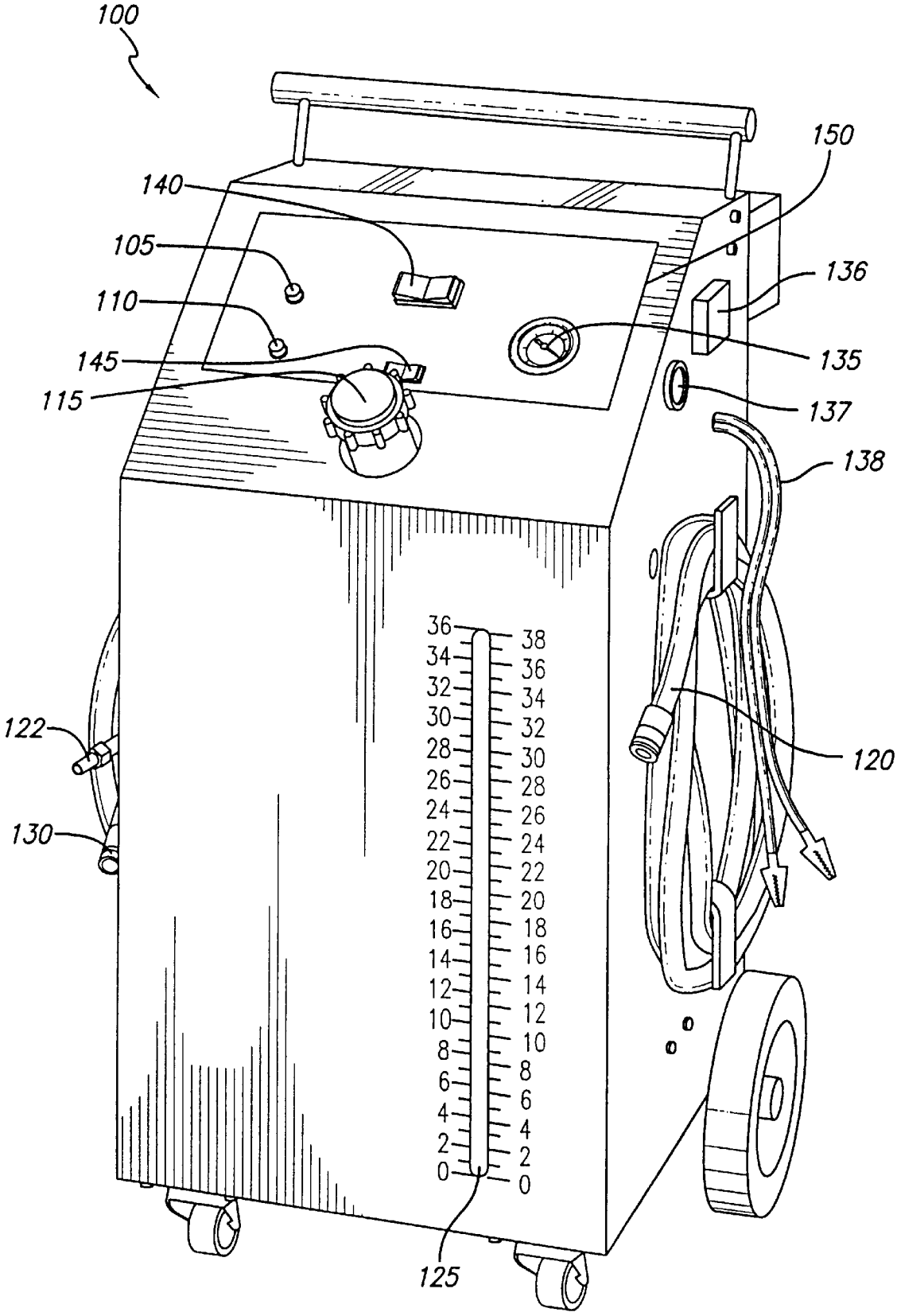
FIG. 1A depicts one embodiment of an engine cooling system service apparatus.

FIG. 1A illustrates an exemplary embodiment of an engine cooling system service apparatus 100 of the present invention. As depicted in FIG. 1A, the service apparatus 100 comprises a front control panel 150. The control panel 150 is shown in more detail in FIG. 1B.

Figure 1B:
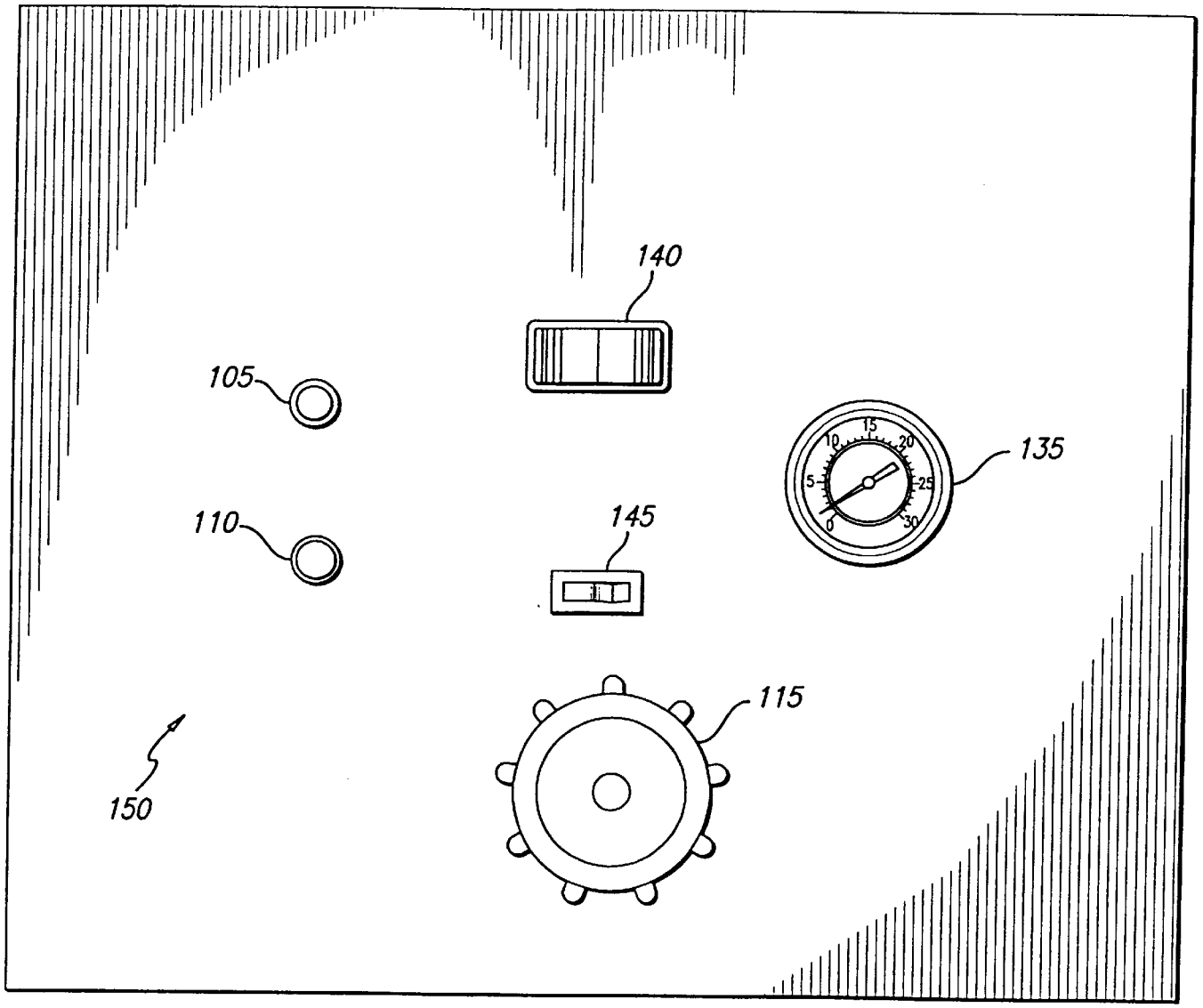
FIG. 1B depicts an example control panel of the engine cooling system service apparatus of FIG. 1A.

Referring to FIG. 1B, the control panel includes a fluid filler neck 115 for adding coolant mixture to a reservoir tank 265 (see FIG. 2) of the service apparatus 100. The control panel 150 further includes a top-off switch 145 that is used to top-off or add coolant to the engine cooling system (not shown) upon completion of the service procedure.

The control panel 150 also includes a three-position mode switch 140 for selecting the service apparatus 100 modes of operation. In one embodiment, the mode switch 140, when placed in the center position, indicates that the service apparatus 100 is in off or by-pass mode of operation. The mode switch 140, when placed in the left position, indicates that the service apparatus 100 is in vacuum mode. The mode switch 140, when placed in the right position, indicates that the service apparatus is in fluid exchange mode.

The control panel 150 includes a low-fluid-level indicator light 110 that illuminates when coolant mixture in the reservoir tank 265 (see FIG. 2) falls below a predetermined low fluid level. The control panel 150 further includes a service-in-progress indicator light 105 that illuminates when the service apparatus 100 is placed in fluid exchange mode. The control panel 150 also includes a pressure gauge 135 that displays fluid pressure in the service apparatus 100.

Figure 2:
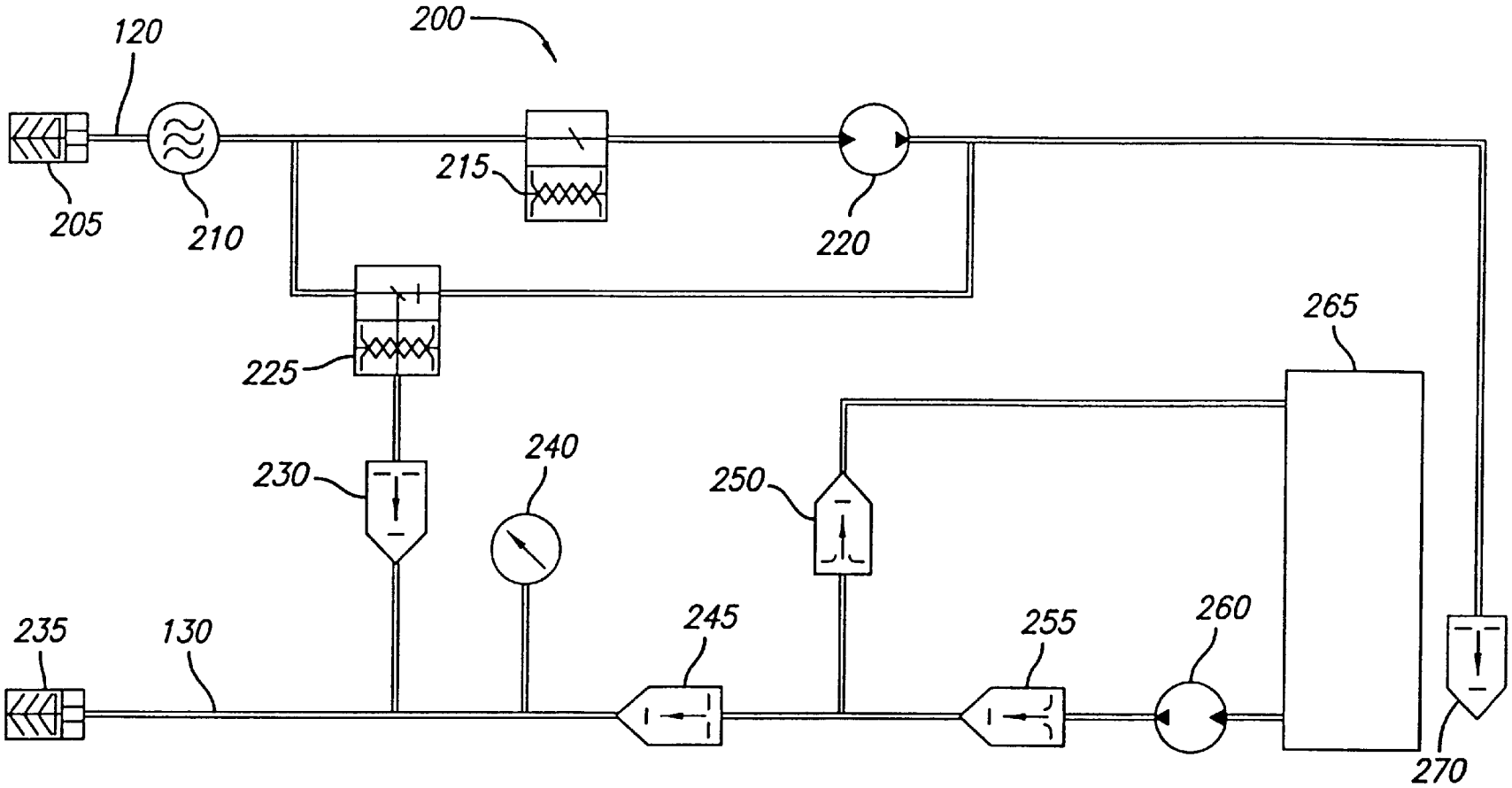
FIG. 2 depicts an example flow schematic of the engine cooling system service apparatus of FIG. 1A.

Turning back to FIG. 1A, it is shown that the service apparatus 100 also comprises a tank-level indicator 125 that indicates the coolant mixture level in the reservoir tank 265 (see FIG. 2). The service apparatus 100 further comprises a used coolant hose (inlet) 120, a new coolant hose (outlet) 130, a disposal hose 122, battery cables 138, a circuit breaker 136 and a warning alarm 137. The used coolant hose 120 is used to receive old coolant from the engine's outlet (not shown), and the new coolant hose 130 provides new coolant from the reservoir tank 265 (see FIG. 2) to the engine's inlet (not shown). The disposal hose 122 is used for transferring old coolant to a disposal tank (not shown). The battery cables 138 make it possible to utilize a vehicle's battery to provide power to the service apparatus 100. The circuit breaker 136 provides circuit protection to the internal circuitry of the service apparatus 100, as described below. The warning alarm 137 is used to alert the operator of the service apparatus 100, for example, when the reservoir tank 265 (see FIG. 2) falls below a certain level or becomes empty.

Figure 3:
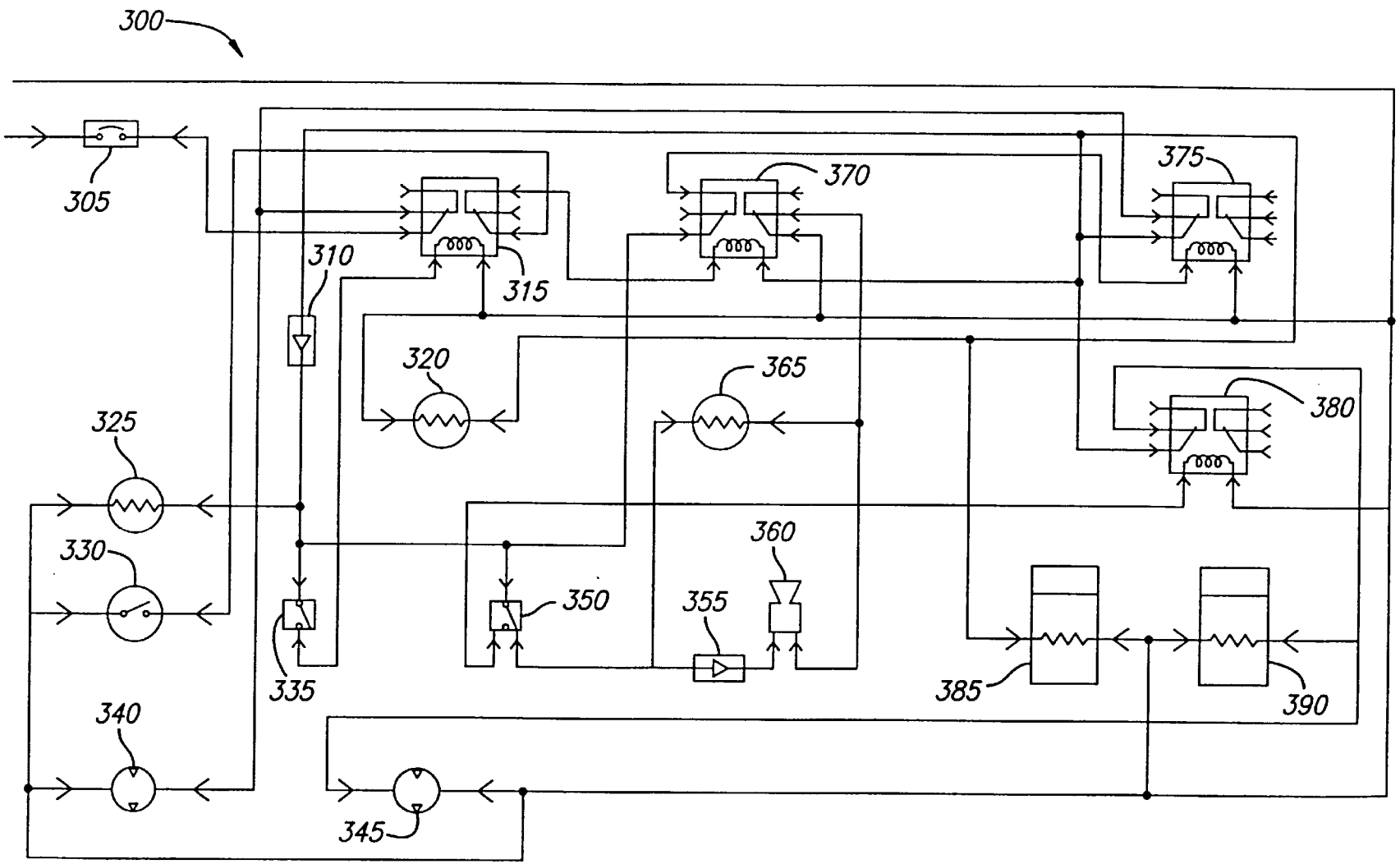
FIG. 3 depicts an example electrical schematic of the engine cooling system service apparatus of FIG. 1A.

The service apparatus 100 further comprises a flow system 200 and an electrical system 300, as shown in FIGS. 2 and 3.

To begin a service process of a vehicle's engine cooling system using the service apparatus 100, the battery cables 138 are connected to the vehicle's battery (not shown). Next, the disposal hose 122 should be inserted in the disposal tank (not shown). As a preferred step, at this point, the used coolant hose 120 should be inserted into the vehicle's overflow radiator tank (not shown). Next, the mode switch 140 should be placed in vacuum mode to evacuate approximately half of the amount of coolant in the vehicle's overflow tank. The mode switch 140 should then be placed in the off position.

In the next step of the process, the vehicle's overflow tank hose (not shown) should be disconnected and then used coolant hose 120 should be connected to the vehicle's radiator nipple (not shown). Next, the mode switch 140 should be placed in vacuum mode to evacuate more coolant. At this stage, the vehicle's pressure release lever (not shown) should be pulled to release any pressure and then the vehicle's radiator cap should be removed.

At this point, the used coolant hose 120 should be disconnected from the vehicle's radiator nipple and should be inserted into the vehicle's radiator fill neck (not shown). Next, the mode switch 140 should be placed in vacuum mode to evacuate coolant until coolant in the radiator preferably falls below the vehicle's upper radiator hose connection. As for the next step of the operation the used coolant hose 120 should be removed from the vehicle's radiator and reinserted into the vehicle's radiator overflow tank to evacuate the overflow tank completely using the vacuum mode of the service apparatus 100.

At this stage, the vehicle's upper radiator hose should be disconnected from the vehicle's radiator inlet (not shown). Next, the new coolant hose 130 should be connected to the radiator inlet and the used coolant hose 120 should be connected to the vehicle's upper radiator hose. At this point, the mode switch 140 may be placed in fluid exchange mode to replace used coolant with new coolant from the reservoir tank 265. This operation should continue until the coolant level has reaches a middle point in the vehicle's radiator filler neck (not shown). Next, the mode switch 140 should be placed in off mode and the vehicle's radiator cap reinstalled securely.

At this step, the vehicle's engine should be started and the mode switch 140 of the service apparatus 100 should be placed in fluid exchange mode. This operation should continue until the tank-level indicator 125 indicates that new coolant has fallen below a low level or until the coolant in the disposal hose 122 appears to be clean. If either condition occurs, the mode switch 140 should be placed in off position and the vehicle's engine should be turned off.

In a preferred embodiment, when the reservoir tank 265 falls below a predetermined low level, the low-fluid-level indicator 110 illuminates and the warning alarm 137 sounds to indicate that the fluid exchange operation has ended. At this stage, the service apparatus 100 automatically reverts to the bypass or off mode and the vehicle's coolant simply passes through the service apparatus 100 and return to the vehicle in a closed loop fashion. Once the mode switch 140 is placed in off mode, the warning alarm's 137 audible sound becomes disabled.

At this point, the disposal hose 122 should be removed from the disposal tank and inserted into the vehicle's coolant recovery tank (not shown). Next, the service apparatus 100 should be placed in vacuum mode via the mode switch 140 to fill the vehicle's coolant recovery tank. Once the vehicle's coolant recovery tank reaches an acceptable fluid level, the switch mode 140 should be placed in off position to end the vacuum operation.

For the next step of the service operation, the pressure gauge 135 should be checked to verify that service apparatus 100 indicates zero or about zero pressure. Next, the vehicle's radiator cap (not shown) should be removed in order to assure that the coolant level in the vehicle's radiator is below the upper radiator hose connection point. If the coolant level in the radiator is unacceptable, the disposal hose 122 should be inserted in a disposal tank—or preferably a clean tank—and the mode switch should be placed in vacuum mode to drain the excess clean coolant from the vehicle's radiator. Next, the service apparatus 100 should be disconnected from the vehicle and the vehicle's upper radiator hose should be connected to the radiator and overflow tank hose to radiator nipple.

At this stage, the new coolant hose 130 should be inserted into the vehicle's radiator filler neck and the top-off switch 145 should be turned on, i.e., placed in top-off mode, in order to fill or top-off the coolant in the radiator. Preferably, similar top-off procedure should be followed to fill or top-off the coolant in the radiator overflow tank, if deemed necessary. At this point, the service process is complete in accordance with one exemplary method of the present invention.

Turning to the flow system 200, the aforementioned modes of operation of the service apparatus 100 are described below.

In one mode of operation, the service apparatus 100 is in off or by-pass mode when the mode switch 140 is placed in off position. The off mode is the default setting of the service apparatus 100. In this mode, when the service apparatus 100 is connected to an operating vehicle, the service apparatus is in a flow through or by-pass mode. In other words, the coolant fluid flowing from the vehicle passes through the service apparatus 100 and return to the vehicle's system.

Referring to FIG. 2, the off or by-pass mode may be described as follows. A used coolant hose connector 205, preferably a hydraulic connector, couples the used coolant hose 120 to the vehicle's radiator system. Similarly, a new coolant hose connector 235, preferably a hydraulic connector, couples the new coolant hose 130 to the vehicle's radiator system. In the by-pass mode, a vacuum solenoid 215, preferably a two-way solenoid, and a vacuum pump 220 are turned off such that no fluid may flow through the vacuum solenoid 215 or the vacuum pump 220. An exchange solenoid 225, preferably a three-way solenoid, on the other hand, is set such that the fluid passes through the exchange solenoid 225 down to a used-coolant check valve 230. The used-coolant check valve 230 allows used fluid to flow through and towards the new coolant hose connector 235.

As shown, a new coolant check valve 245 is strategically positioned to prevent flow of used coolant towards the new coolant reservoir tank 265. A filer 210 is preferably placed in the fluid path to prevent unwanted particles from blocking the fluid paths, the solenoids 215 and 225 or the vacuum pump 220. The pressure gauge 240 also provides the operator with the service apparatus 100 pressure based on which the operator may determine as to whether the flow has been restricted. Accordingly, in off or by-pass mode, used coolant enters the service apparatus 100, passes through the used coolant hose connector 205 and through the used coolant hose 120 through a filter 210, through the exchange solenoid 225, through the used-coolant check valve 230 and then through the new coolant hose 130 and the new coolant hose connector 235 back to the vehicle's radiator system (not shown).

Conventional service machines however, merely provide an open hose that causes the vehicle's fluid to flow out of the vehicle's radiator system when the vehicle's engine is running. As a result, the vehicle's radiator system loses its fluid and the vehicle's engine overheats. In this exemplary embodiment of the present invention, on the other hand, a close loop is established in the off mode that causes the vehicle's radiator fluid to return back to the radiator system while the vehicle's engine is running. In other words, no fluid is taken out of the vehicle's radiator and no fluid is added, rather the used radiator fluid simply cycles through the service apparatus 100 and returns back into the vehicle's radiator system. The off mode of the present invention is even more advantageous in conjunction with the fluid exchange mode, as explained below, wherein the service apparatus automatically reverts to the off mode at the end of the fluid exchange mode and causes the fluid to circulate and not to be drawn out of the vehicle's radiator system at the end of the fluid exchange process. In conventional systems, however, the operator must manually control this time critical process.

In the vacuum mode of operation, the vacuum pump 220 and the vacuum solenoid 215 are activated to apply vacuum to the vehicle's radiator system. As a result, used coolant is pulled from the vehicle's system through the used coolant hose connector 205 and the used coolant hose 120, through the filer 210, the vacuum solenoid 215 and the vacuum pump 220. The old coolant then flows to a waste check valve 270 to the disposal tank (not shown) or a clean tank, if clean fluid is being vacuumed.

The flow system 200 also includes a pressure pump relief valve 255 that can prevent an unwanted hydraulic pull that may be created due to human errors. An unwanted hydraulic pull may occur if the operator erroneously connects the new fluid hose 130 and the used fluid hose 120 to the vehicle's system in place of the other. In this case, an unwanted hydraulic pull is created between the new coolant hose connector 235 and the used coolant hose connector 205 and the vacuum pump 220 that may cause new fluid to be drawn from the new fluid reservoir tank 265. The pressure pump relief valve 255 is positioned to prevent new fluid to be drawn from the reservoir 265 as a result of a hydraulic pull.

In conventional service machines, in order to prevent drainage of coolant into public drainage system, the operator must place a pan under the vehicle to retain spills. The performance of this step is required by the environmental law to prevent drainage of hazardous materials.

When the service apparatus 100 is placed in fluid exchange mode via the mode switch 140, the service-in-progress indicator light 105 illuminates, and a pressure pump 260 and the exchange solenoid 225 are activated. In this mode, the old fluid enters the service apparatus 100 through the used coolant hose connector 205 and the used coolant hose 120. The old fluid then flows through the filter 210, bypassing the path including the vacuum solenoid 215 and the vacuum pump 220, because they are both in off state, but flowing through the exchange solenoid 225 to reach the waste check valve 270. The exchange solenoid's 225 path to the used-coolant check valve 230 is deactivated so that flow of used fluid towards the used-coolant check valve 230 is not allowed. Furthermore, the pressure pump 260 is activated to pump new fluid out of the new fluid reservoir tank 265 towards the pressure pump relief valve 255, passed the new fluid check valve 245 towards the new fluid hose 130 and the new fluid hose connector 235 into the vehicle's radiator system. An excess pressure relief valve 250 is preferably positioned such that it is connected to the reservoir tank 265 at one end and between the pressure pump relief valve 255 and the new fluid check valve 245 at the other end. The purpose of the excess pressure relief valve 250 is to allow new fluid to revert back into the reservoir tank 265 partially or completely depending upon the rate at which the vehicle's system is accepting new fluid. The excess pressure relief valve 250 opens based on excess pressure, so that the vehicle's engine or the service apparatus 100 do not have to be stopped and restarted to adjust inflow or outflow of the fluid. Rather, the fluid flow is automatically controlled via the excess pressure relief valve 250. In some conventional systems, an electrical switch is used to stop the pressure pump at a given pressure. Accordingly, in such machines, the flow of fluid cannot be partially controlled but path is either closed or open.

During the fluid exchange mode, the pressure gauge 240 provides the service apparatus 100 pressure to the operator, so the operator may determine the flow speed and whether the flow as is restricted. During this operation, a used-coolant check valve 230 is positioned to prevent flow of fluid to the exchange solenoid 225. The used-coolant check valve 230, however, may not be used, in some embodiments, since the exchange solenoid 225 may itself block flow of new fluid. Yet, the used-coolant valve 230 serves an advantageous purpose, for example in the vacuum mode, wherein the operator may erroneously utilize the new coolant hose 130 rather than the used coolant hose 120 to vacuum fluid.

The top-off mode of operation is activated when the top-off switch 145 is turned on. As described above, in one mode of: operation the fluid exchange mode terminates when new fluid in the reservoir tank 265 reaches a predetermined low level. At this stage, the reservoir tank 265 preferably contains approximately three quarts of new fluid. The top-off mode of the service apparatus 100 overrides the low-level shut-down and allows more fluid, below the low-level in the reservoir tank 265, to be withdrawn from the reservoir tank 265 in order to top-off the vehicle's radiator system. In conventional systems, the operator must either make a batch of new fluid by mixing water and coolant or save some new fluid in a separate container in order to manually top-off the cooling system and fill the radiator overflow tank at the end of the fluid exchange operation.

Activating the top-off switch 145 causes the low-fluid-level indicator light to go off. In this mode, the pressure pump 260 is activated causing new fluid to be pump out of the reservoir tank 265 towards the pressure pump relief valve 255, passed through the new fluid check valve 245 to the new fluid hose 130 and the new fluid hose connector 235 into the vehicle's radiator system. During the top-off mode, some new fluid may revert back to the reservoir tank 265 via the excess pressure relief valve 250. As explained above, the excess pressure relief valve 250 opens partially or completely depending upon the back pressure.

Turning to FIG. 3, an exemplary electrical system 300 of the present invention is illustrated. The electrical system 300 includes a circuit breaker element 305 in connection with the circuit breaker 136. The circuit breaker element 305 provides protection to the electrical system 300 against unwanted voltage fluctuations. The electrical system 300 further includes four relays 315, 370, 375 and 380 that are set up according to the modes of operation of the service apparatus 100. The electrical system 300 also includes electrical connections for a service light 320 and a low-level light 365 to provide illumination to the service-in-progress indicator light 105 and the low-level-fluid indicator light 110, respectively. FIG. 3 further illustrates that the service light 320 is in communication with a diode 310 and a top-off switch 335 via the relay 315. As a result in the fluid exchange mode, the relay 315 is activated such that the service light 320 provides voltage to illuminate the service-in-progress indicator light 105 and also to turn the pressure pump 340 on.

The electrical system 300 further comprises pump electrical connections 340 and 345 to provide electrical voltage to pressure pump 260 and the vacuum pump 220, respectively. A low level switch 330 is also provided to terminate the exchange fluid mode and cause the service apparatus 100 to revert to off mode when the reservoir tank 265 reaches a predetermined low fluid level. As shown, the electrical system 300 also provides an alarm electrical connection 360 to activate or deactivate the warning alarm 137. The alarm electrical connection is further connected to an alarm diode 355 that is coupled to the relay 370. The electrical system 300 further comprises solenoid electrical connections 385 and 390 to control the operation of the vacuum solenoid 215 and the exchange solenoid 225, respectively.

Figure 4:
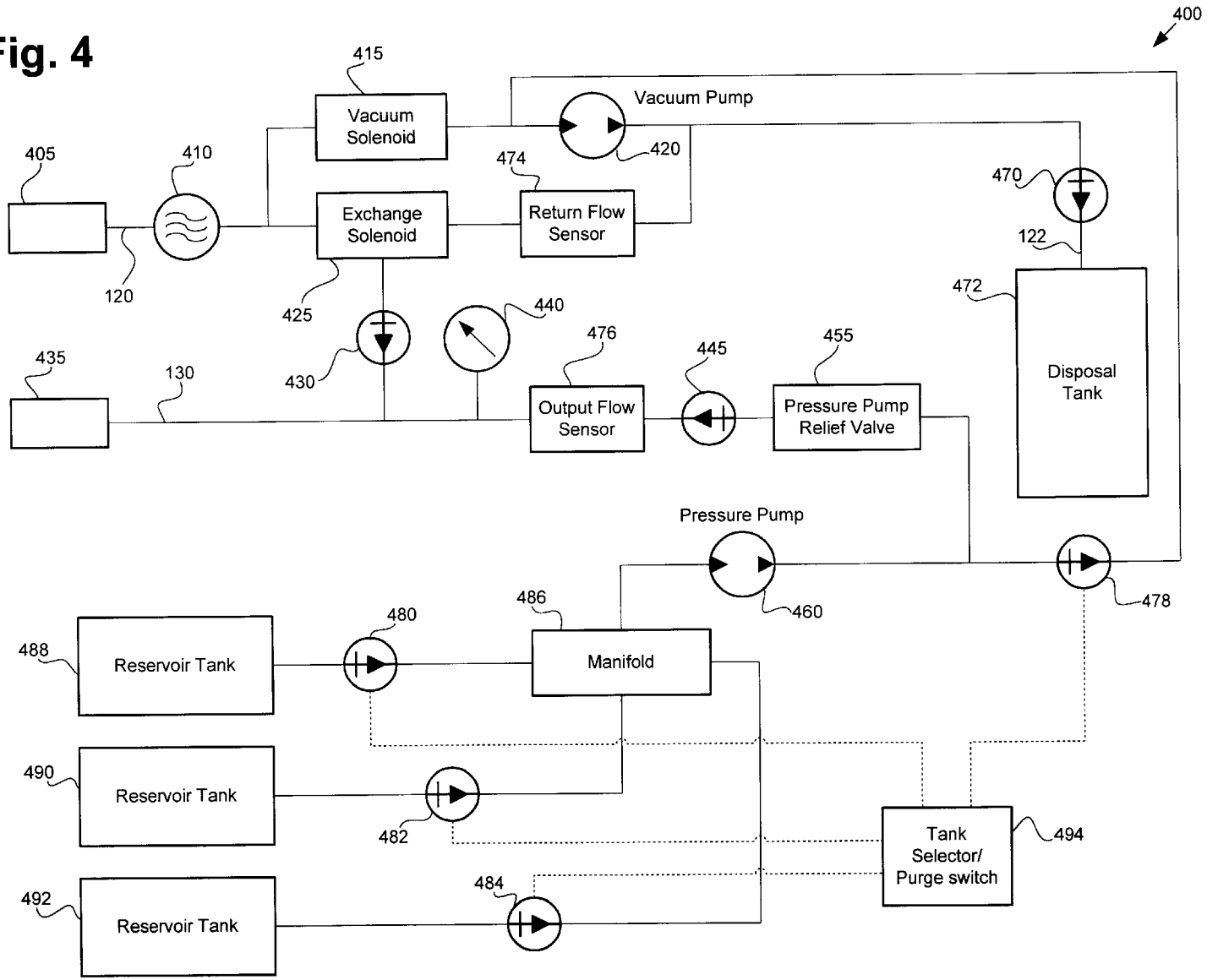
FIG. 4 depicts an example flow schematic of a multi-tank engine cooling system service apparatus according to one embodiment of the present invention.

FIG. 4 shows a flow diagram of multi-tank engine cooling system service apparatus 400 according to one embodiment of the present invention. Multi-tank service apparatus 400 includes used coolant hose connector 405, filer 410, vacuum solenoid 415, vacuum pump 420, exchange solenoid 425, used coolant check valve 430, new coolant hose connector 435, pressure gauge 440, new coolant check valve 445, pump relief valve 455, pressure pump 460, and waste check valve 470, which respectively correspond to used coolant hose connector 205, filer 210, vacuum solenoid 215, vacuum pump 220, exchange solenoid 225, used coolant check valve 230, new coolant hose connector 235, pressure gauge 240, new coolant check valve 245, pump relief valve 255, pressure pump 260, and waste check valve 270 in FIG. 2. Multi-tank service apparatus 400 further includes disposal tank 472, return flow sensor 474, output flow sensor 476, solenoid check valves 478, 480, 482, and 484, manifold 486, reservoir tanks 488, 490, and 492, and tank selector/purge switch 494.

The multi-tank service apparatus 400 is connected to a vehicle's engine cooling system in a similar manner as the service apparatus 100 described above. Also, in the by-pass mode and the vacuum mode, the operation of the multi-tank service apparatus 400 is substantially similar to the operation of the service apparatus 100 described above. However, in the fluid exchange mode and the top-off mode, the operation of the multi-tank service apparatus 400 may differ from the operation of the service apparatus 100, as described below.

As shown in FIG. 4, the multi-tank service apparatus 400 includes a return flow sensor 474 for measuring the amount of used coolant returning to the multi-tank service apparatus 400 by way of the path including used coolant hose 120, filer 410, and exchange solenoid 425 in the fluid exchange mode. The return flow sensor 474 can be a digital flow sensor, such as a Hall Effect Turbine Flow Sensor capable of electronically metering the amount of used coolant entering the multi-tank service apparatus 400 via the above path in the fluid exchange mode. The return flow sensor 474 can communicate to a microprocessor (not shown in FIG. 4) the amount of used coolant entering the multi-tank service apparatus 400 in the fluid exchange mode. For example, a microprocessor can receive a signal from the return flow sensor 474 and count the number of pulses on that signal to determine the amount of used coolant entering the multi-tank service apparatus 400 in the fluid exchange mode.

The multi-tank service apparatus 400 also includes an output flow sensor 476 for measuring the amount of new fluid flowing out of the multi-tank service apparatus 400 via the new coolant hose 130 in the fluid exchange mode. The output flow sensor 476 is similar to the return flow sensor 474 described; above. In one embodiment, the return flow sensor 474 and the output flow sensor 476, respectively, may communicate to a microprocessor (not shown in FIG. 4) the amount of used fluid flowing into and the amount of new fluid flowing out of multi-tank service apparatus 400. In the fluid exchange mode, the microprocessor may utilize the amount of fluid flow communicated via the return flow sensor 474 and the output flow sensor 476 to balance the amount of used fluid flowing into the multi-tank service apparatus 400 and the amount of new fluid flowing out of the multi-tank service apparatus 400. For example, based on the difference in the in-flow rate and the out-flow rate, the microprocessor may increase or decrease the speed of pressure pump 460.

The multi-tank service apparatus 400 includes reservoir tanks 488, 490, and 492, a manifold 486, and reservoir tank solenoid check valves 480, 482, and 484. The reservoir tanks 488, 490, and 492, respectively, arc coupled to the manifold 486 via the reservoir tank solenoid check valves 480, 482, and 484, and the manifold 486 is coupled to the pressure pump 460. The reservoir tanks 488, 490, and 492 provide a supply of new coolant. In one embodiment, the reservoir tanks 488, 490, and 492 may each contain a supply of a different type of new coolant. The reservoir tanks 488, 490, and 492 may also include low level switches, such as the low level a switch 330 in FIG. 3, to terminate the fluid exchange mode and cause the multi-tank service apparatus 400 to revert to the off mode when the appropriate reservoir tank reaches a predetermined low fluid level. The reservoir tank solenoid check valves 480, 482, and 484, respectively, allow new fluid to be pumped by the pressure pump 460 from the reservoir tanks 488, 490, and 492 when the reservoir tank solenoid check valves 480, 482, and 484 are open. The reservoir tank solenoid check valves 480, 482, and 484, respectively, also prevent fluid from flowing back into the reservoir tanks 488. 490, and 492.

As shown in FIG. 4, a tank selector/purge switch 494 is connected to the reservoir tank check valves 480, 482, and 484 to provide a means of opening and closing the reservoir tank solenoid check valves 480, 482, and 484, respectively. For example, in the fluid exchange mode, the tank selector/purge switch 494 may be turned to the "tank 1," "tank 2," or "tank 3 " position to open the respective reservoir tank solenoid check valve 480, 482, or 484 to allow the pressure pump 460 to pump fluid from the reservoir tank 488, 490, or 492. Thus, the multi-tank service apparatus 400 advantageously allows the operator to switch coolant types by selecting a different reservoir tank without having to spend valuable service time draining and refilling a single tank, as required in a one-tank service apparatus.

The multi-tank service apparatus 400 further includes a purge solenoid check valve 478, which is coupled between the connection point where the vacuum solenoid 415 is coupled to the vacuum pump 420 and the connection point where the pressure pump 460 is coupled to the pressure relief valve 455. The purge solenoid check valve 478 is connected to the tank selector/purge switch 494 to provide a means of opening and closing the purge check valve 478. For example, when the tank selector/purge switch 494 is turned to the "purge" position, the purge solenoid check valve 478 is opened.

In purge mode, for example, the purge solenoid check valve 478 may be opened to allow the vacuum pump 420 to purge the fluid lines by pulling coolant in the fluid lines through the vacuum pump 420 and into the disposal tank 472 via the waste check valve 470. In one embodiment, the purge check valve 478 and the vacuum pump 420 may be controlled by a microprocessor to automatically purge the fluid lines as appropriate. As shown, in purge mode, vacuum pump 420 purges fluid in output and return lines of the multi-tank servicing apparatus 400. In one embodiment, the multi-tank servicing apparatus 400 may include a purge pump, which can be used in place of the vacuum pump 420, when the multi-tank servicing apparatus 400 is placed in the purge mode. Thus, by providing a means of purging the above fluid lines, the multi-tank servicing apparatus 400 beneficially reduces cross-contamination that may result from intermixing of different fluid types during a switch over from one reservoir tank to another, for example, from the reservoir tank 488 to the reservoir tank 490.

The multi-tank service apparatus 400 further includes a disposal tank 472, which is coupled to the waste check valve 470 via the disposal hose 122 to provide an on-board receptacle for used coolant. It is noted that the disposal hose 122 may be easily removed from the disposal tank 472 to allow the multi-tank service apparatus 400 to utilize the disposal hose 122 in a similar manner as discussed above in operation of service apparatus 100.

In one embodiment, similar to the excess pressure relief valve 250 in FIG. 2, an excess pressure relief valve (not shown) may be connected between the new fluid check valve 445 and the pressure pump relief valve 455 and a manifold (not shown). The manifold may be further coupled to the reservoir tanks 488, 490, and 492 via three fluid lines each including a solenoid check valve to open and close the respective fluid connection between the reservoir tanks 488, 490, and 492 and the manifold. The excess pressure relief valve and the solenoid check valves may be controlled by a microprocessor to allow new fluid to revert back into the appropriate reservoir tank, i.e. the reservoir tank 488, 490, or 492. The microprocessor may also be configured to allow the excess pressure relief valve to open partially or, completely depending upon the rate at which the vehicle's system is accepting new fluid.

In one embodiment, when the fluid level in the selected reservoir tank, i.e. the reservoir tank 488, 490, or 492, falls below a predetermined low level, the multi-tank service apparatus 400 automatically reverts to the bypass or off mode in a similar manner described above in the operation of the service apparatus 100. During the top-off mode of operation discussed above, the multi-tank service apparatus 400 overrides the low-level shut-down and allows more fluid, below the predetermined low level in the reservoir tank 488, 490, or 492, respectively, to be withdrawn from the reservoir tank 488, 490, or 492 in order to top-off the vehicle's radiator system.

Figure 5:
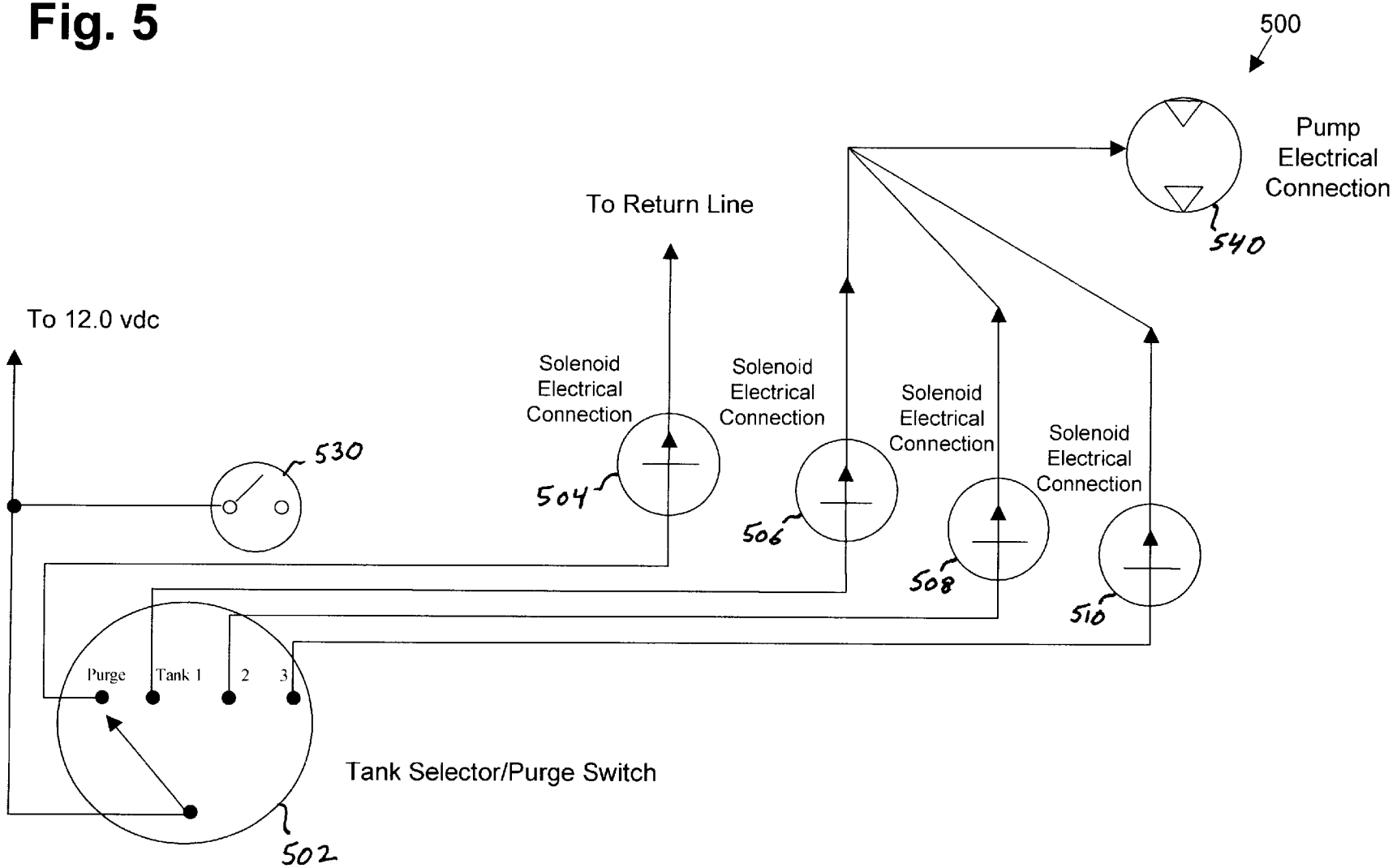
FIG. 5 depicts an example partial electrical schematic of the multi-tank engine cooling system service apparatus of FIG. 4.

FIG. 5 shows an exemplary partial electrical system of the multi-tank service apparatus 400 in FIG. 4. Electrical system 500 can be combined with electrical system 300 in FIG. 3 to form a complete exemplary electrical system of the multi-tank service apparatus 400. The low-level switch 530 and the pump electrical connection 540, respectively correspond to the low-level switch 330 and the pump electrical connection 340 in FIG. 3. Electrical system 500 includes the solenoid electrical connections 504, 506, 508, and 510 to control the operation of the purge solenoid check valve 478 and the reservoir tank solenoid check valves 480, 482, and 484, respectively.

Electrical system 500 further includes a tank selector/purge switch 502 connected to solenoid electrical connections 504, 506, 508, and 510. For example, when the tank selector/purge switch 502 is turned to the "purge," "tank 1," "tank 2," or "tank 3" position, the solenoid electrical connection 504, 506, 508, or 510 is activated, respectively. The solenoid electrical connections 506, 508, and 510 are also connected to the pump electrical connection 540 to provide power to pressure pump 460 in FIG. 4 whenever the solenoid electrical connection 506, 508, or 510 is activated via the tank selector/purge switch 502.

Figure 6:
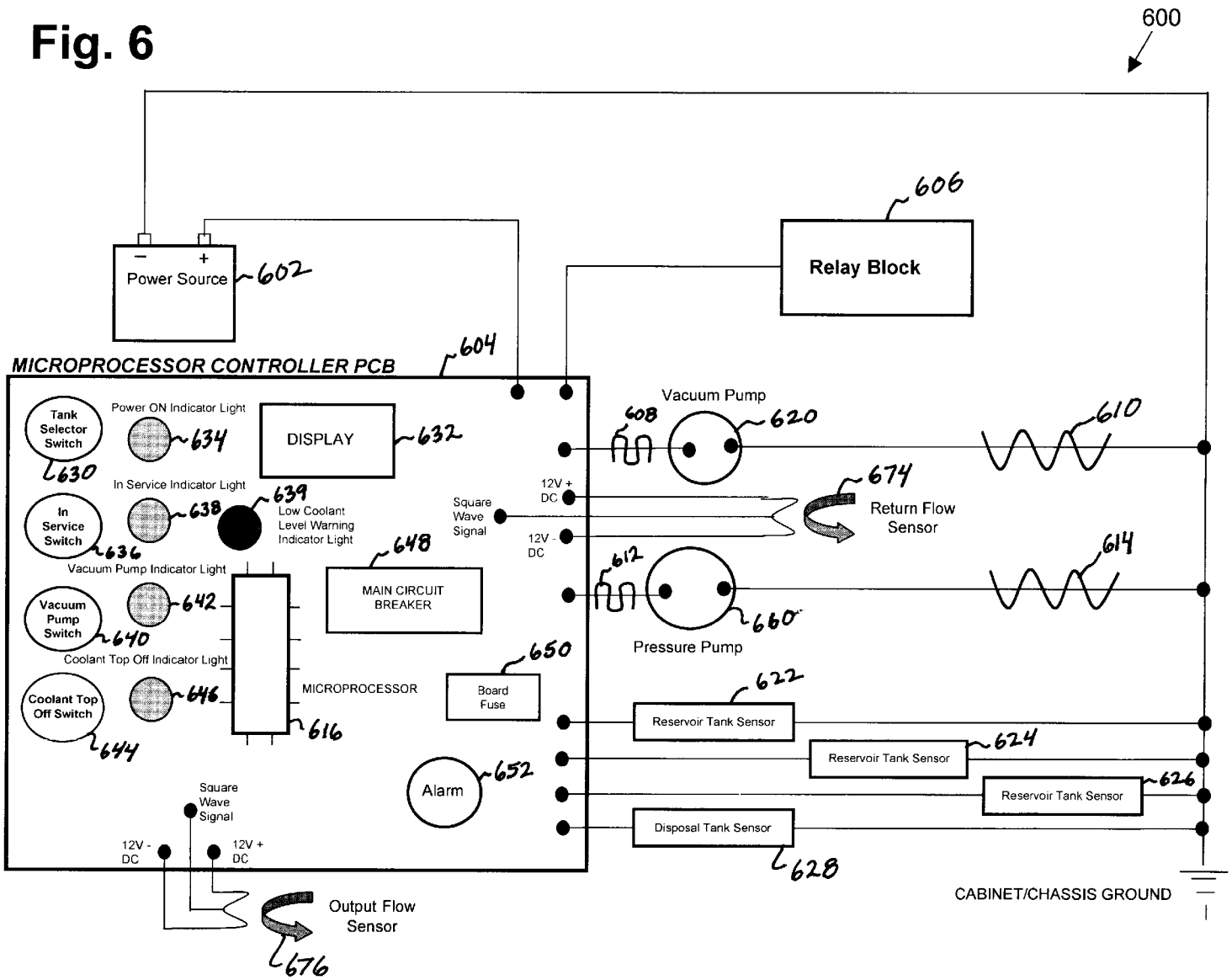
FIG. 6 depicts an example electrical schematic of the multi-tank engine cooling system service apparatus of FIG. 4.

Turning now to FIG. 6, an exemplary electrical system 600 is shown for the multi-tank service apparatus 400 in FIG. 4. The electrical system 600 includes a power source 602, which is connected to a microprocessor controller printed circuit board (PCB) 604. The power source 602 provides 12.0 vdc power to the multi-tank service apparatus 400, and can be a car battery. In one embodiment, the power source 602 may be a 120.0 vac 50.0 or 60.0 cycle power source containing a 12.0 vdc power supply. It should be noted that in other embodiments the power source 602 may be a 220.0/240.0 vac 50.0 or 60.0 cycle power source containing a 12.0 vdc power supply, or a 24.0 vdc power source that is converted to 12.0 vdc by a step-down DC to DC voltage converter.

The electrical system 600 also includes a relay block 606, which is coupled to the microprocessor controller PCB 604. The relay block 606 includes relays that perform similar functions as relays 315, 370, 375, and 380 in FIG. 3. The electrical system 600 further includes a vacuum pump 620 and a pressure pump 660, which respectively correspond to the vacuum pump 420 and the pressure pump 460 in FIG. 4. For example, the vacuum pump 620 and the pressure pump 660 may be 12.0 vdc diaphragm, centrifugal, or impeller pumps. In one embodiment, the electrical system 600 also includes a purge/waste pump for purging the fluid lines of the multi-tank service apparatus 400 when the multi-tank service apparatus 400 is in the purge mode. The electrical system 600 also includes inductor filter coils 608, 610, 612, and 614, which can be pass-through filters for eliminating electromagnetic interference (EMI). For at example, the inductor filter coils 608 and 610 may eliminate EMI produced by the vacuum pump 620, and the inductor filter coils 612 and 614 may eliminate EMI produced by the pressure pump 660.

The electrical system 600 further includes a return flow sensor 674 and an output flow sensor 676 which respectively correspond to the return flow sensor 474 and the output flow sensor 476 in FIG. 4. The return flow sensor 674 and the output flow sensor 676 can communicate with the microprocessor 616 on the microprocessor controller PCB 604.

The electrical system 600 also includes reservoir tank sensors 622, 624, and 626 for detecting a low fluid level in the reservoir tanks 488, 490, and 492 in FIG. 4, respectively. The reservoir tank sensors 622, 624, and 626 may be optical, magnetic, reed, float, proximity, or variable resistance switches. In one embodiment, the reservoir tank sensor 622, 624, or 626 can send a signal to the microprocessor 616 indicating a low fluid level in the reservoir tank 488, 490, or 492, respectively, and the microprocessor 616 can shut down the multi-tank service apparatus 400. The electrical system 600 further includes a disposal tank sensor 628 for detecting a high fluid level in a disposal tank, such as the disposal tank 472 in FIG. 4.

The electrical system 600 further includes a microprocessor controller PCB 604. The microprocessor controller PCB 604 includes a tank selector switch 630, a display 632, and a microprocessor 616. The tank selector switch 630 provides a means for selecting a particular reservoir tank, such as reservoir tank 488, 490, or 492 in FIG. 4. The particular reservoir tank selected by the tank selector switch 630 can be indicated on the display 632. In one embodiment, the tank selector switch 630 may be turned to the "tank 1," "tank 2," or "tank 3" position to respectively select reservoir tank 488, 490, or 492, and the display 632 may accordingly indicate "tank 1," tank 2," or "tank 3." The display 632 can be controlled by the microprocessor 616, and may be a digital display or a membrane or a membrane keypad with LED indicators. Microprocessor 616 can be a microprocessor chip, such as those manufactured by Intel, Motorola, AMD, etc., which is used to control the multi-tank service apparatus 400.

The microprocessor controller PCB 604 also includes a power on indicator light 634, which illuminates when the power source 602 is connected to the microprocessor controller PCB 604. The microprocessor controller PCB 604 further includes an in service switch 636 for selecting the fluid exchange mode. For example, the in service switch 636 may be pressed to place the multi-tank service apparatus 400 in the fluid exchange mode. The microprocessor controller PCB 604 also includes an in service indicator light 638, which lights when the multi-tank service apparatus 400 is placed in the fluid exchange mode. The microprocessor controller PCB 604 also includes a low coolant level warning indicator light 639, which may illuminate when reservoir tank sensors 622, 624, or 626 detect a low coolant level condition in the reservoir tank 488, 490, or 492, respectively.

The microprocessor controller PCB 604 further includes a vacuum pump switch 640 for selecting the vacuum mode. For example, the vacuum pump switch 640 may be pressed to place the multi-tank service apparatus 400 in the vacuum mode. The microprocessor controller PCB 604 also includes a vacuum pump indicator light, which illuminates when the multi-tank service apparatus 400 is in the vacuum mode. The microprocessor controller PCB 604 further includes a coolant top-off switch 644 for selecting the top-off mode. For example, the coolant top-off switch 644 may be pressed to place the multi-tank service apparatus 400 in the top-off mode. The microprocessor controller PCB 604 further includes a coolant top-off indicator light, which illuminates when the multi-tank service apparatus 400 is in the top-off mode.

The microprocessor controller PCB 604 also includes a main circuit breaker 648, which provides protection to the electrical system 600 against unwanted voltage fluctuations. The main circuit breaker 648 may be a pop-out circuit breaker with a current rating of 10.0 amperes. The microprocessor controller PCB 604 further includes a board fuse 650, which provides protection for the electrical components on the microprocessor controller PCB 604. The board fuse 650 may be a fuse of a proper rating or standard switch-type circuit breaker. The microprocessor controller PCB 604 further includes an alarm 652 for alerting an operator of the multi-tank service apparatus 400, for example, when the reservoir tank 488, 490, or 492 in FIG. 4 falls below a certain level or becomes empty., The alarm 652 can also alert an: operator, for example, when the disposal tank 472 rises above a predetermined level. In one embodiment, the microprocessor controller PCB 604 may include diagnostic software for verifying proper operation of the multi-tank service apparatus 400.

While particular embodiments, implementations, and implementation examples of the present invention have been described above, it should be understood that they have been presented by way of example only, and not as limitations. The breadth and scope of the present invention is defined by the following claims and their equivalents, and is not limited by the particular embodiments described herein.

What is claimed is:

1. An apparatus for servicing having a used fluid, an inlet and an outlet, said apparatus comprising:

a first hose adapted to be connected to said inlet;

a second hose adapted to be connected to said outlet;

a first fluid tank including a first new fluid;

a second fluid tank including a second new fluid;

a pump; and a selector;

wherein said selector selects one of said first fluid tank and said second fluid tank, and said pump pumps said new fluid from said one of said first fluid tank and said second fluid tank into said system through said first hose and said inlet, and wherein said second hose receives said used fluid via said outlet.

2. The apparatus of claim 1, wherein said first fluid tank communicates with said pump via a first valve and said second fluid tank communicates with said pump via a second valve, and wherein said selector opens said first valve and closes said second valve, so that said pump pumps said first new fluid from said first fluid tank.

3. The apparatus of claim 1, wherein said first fluid tank communicates with said pump via a first valve and said second fluid tank communicates with said pump via a second valve, and wherein said selector opens said second valve and closes said first valve, so that said pump pumps said second new fluid from said second fluid tank.

4. The apparatus of claim 1 further comprising:

an output flow sensor coupled to said first hose;

a return flow sensor coupled to said second hose; and a controller in communication with said output flow sensor for measuring an output rate of flow and in communication with said return flow sensor for measuring a return rate of flow;

wherein said controller controls said pump based on said return rate of flow and said output rate of flow.

5. The apparatus of claim 1 further comprising a purge pump capable of purging said used fluid and said new fluid in said first hose and said second hose.

6. The apparatus of claim 1 further comprising a third fluid tank including a third new fluid.

7. The apparatus of claim 6, wherein said first new fluid is the same as said third new fluid.

8. A method of servicing a system having a used fluid, an inlet and an outlet, said method comprising the steps of:

connecting a first hose to said inlet;

connecting a second hose to said outlet;

selecting a first one of a plurality of fluid tanks, each of said fluid tanks having a new fluid;

pumping said new fluid from said first one of said plurality of fluid tanks into said first hose and said inlet;

receiving said used fluid from said outlet and said second hose; and disposing said used fluid.

9. The method of claim 8 further comprising the steps of selecting a second one of said plurality of said fluid tanks;

pumping said new fluid from said second one of said plurality of fluid tanks into said first hose and said inlet;

receiving said used fluid from said outlet and said second hose; and disposing said used fluid.

10. The method of claim 9 further comprising the step of purging said new fluid and said used fluid in said first hose and said second hose, prior to said step of pumping said new fluid from said second one of said plurality of fluid tanks.

11. The method of claim 8, wherein each of said plurality of said fluid tanks includes a different type of said new fluid.

12. The method of claim 8 further comprising the steps of:

measuring an output rate of flow using an output flow sensor coupled to said first hose;

measuring a return rate of flow using a return flow sensor coupled to said second hose; and controlling said pump based on said measuring steps.

13. An apparatus for servicing a system having a used fluid, an inlet and an outlet, said apparatus comprising:

a first hose adapted to be connected to said inlet;

a second hose adapted to be connected to said outlet;

a first fluid tank including a first new fluid;

a second fluid tank including a second new fluid;

a pump; and a first solenoid coupled to an outlet of said first fluid tank and to an inlet of said pump;

a second solenoid coupled to an outlet of said second fluid tank and said inlet of said pump;

a selector;

wherein said selector activates one of said solenoids and said pump pumps said new fluid from one of said first fluid tank and said second fluid tank, corresponding to said one of said solenoids, into said system through said first hose and said inlet, and wherein said second hose receives said used fluid via said outlet.

14. The apparatus of claim 13 further comprising:

an output flow sensor coupled to said first hose;

a return flow sensor coupled to said second hose; and a controller in communication with said output flow sensor for measuring an output rate of flow and in communication with said return flow sensor for measuring a return rate of flow;

wherein said controller controls said pump based on said return rate of flow and said output rate of flow.

15. The apparatus of claim 13 further comprising a purge pump capable of purging said used fluid and said new fluid in said first hose and said second hose.

16. The apparatus of claim 13 further comprising a third fluid tank including a third new fluid and a third solenoid coupled to an outlet of said third fluid tank and to an inlet of said pump.

17. The apparatus of claim 13, wherein said first new fluid is the same as said second new fluid.

18. A method of servicing a system having a used fluid, an inlet and an outlet, said method comprising the steps of:

connecting a first hose to said inlet;

connecting a second hose to said outlet;

initiating a replacement process including the steps of:

pumping a new fluid through said first hose and said inlet;

receiving said used fluid from said outlet and said second hose; and disposing said used fluid;

terminating said replacement process; and purging said new fluid and said used fluid in said first hose and said second hose.

19. The method of claim 18, wherein said purging step uses a pump to purge said new fluid and said used fluid in said first hose and said second hose.

20. The method of claim 18, wherein prior to said pumping step, said method further comprising the step of selecting one of a plurality of fluid tanks, wherein each tank includes a new fluid.

21. The method of claim 20, wherein each of said plurality of said fluid tanks includes a different type of said new fluid.

22. An apparatus for servicing a system having a used fluid, an inlet and an outlet, said apparatus comprising:

a first hose adapted to be connected to said inlet;

a second hose adapted to be connected to said outlet;

a first fluid tank including a first new fluid; and a purge pump;

wherein said first new fluid is pumped through said first hose and said inlet, and said used fluid is received from said outlet and said second hose for disposal; and wherein, after said used fluid is replaced by said first new fluid, said purge pump purges said first new fluid and said used fluid in said first hose and said second hose.

23. The apparatus of claim 22, wherein said used fluid is replaced with said first new fluid using a pump other than said purge pump.

24. The apparatus of claim 22 further comprising a second fluid tank including a second new fluid and a selector, wherein prior to replacing said used fluid, said selector selects one of said first fluid tank and said second fluid tank.

25. The apparatus of claim 24, wherein said first new fluid is different than said second new fluid.

* * * * *

UNITED STATES PATENT AND TRADEMARK OFFICE

CERTIFICATE OF CORRECTION

PATENT NO. : 6,595,248 B1
DATED : July 22, 2003
INVENTOR(S) : Rome et al.

It is certified that error appears in the above-identified patent and that said Letters Patent is hereby corrected as shown below:

Column 1,
Line 6, reading "This application is a continuation of U.S. application Ser." should read -- This application is a continuation-in-part of U.S. application Ser. --

Column 13,
Line 26, reading "1. An apparatus for servicing having a used fluid, an inlet" should read -- 1. An apparatus for servicing a system having a used fluid, an inlet --.

Signed and Sealed this

Ninth Day of December, 2003

JAMES E. ROGAN
*Director of the United States Patent and Trademark Office*